United States Patent [19]

Roth

[11] 4,350,261

[45] Sep. 21, 1982

[54] CLOSURE HAVING OPENING MEANS

[75] Inventor: Donald J. Roth, Westport, Conn.

[73] Assignee: The Continental Group, Inc., New York, N.Y.

[21] Appl. No.: 194,519

[22] Filed: Oct. 6, 1980

[51] Int. Cl.[3] ..... B65D 17/34

[52] U.S. Cl. ..... 220/270; 220/307

[58] Field of Search ..... 220/260, 266, 269, 270, 220/307; 222/541; 215/252, 254

[56] References Cited

U.S. PATENT DOCUMENTS

| | | | |
|---|---|---|---|
| 3,355,060 | 11/1967 | Reynolds et al. | 220/270 |
| 4,220,249 | 9/1980 | Nilsson | 220/269 X |
| 4,262,815 | 4/1981 | Klein | 220/269 |

*Primary Examiner*—George T. Hall

*Attorney, Agent, or Firm*—John J. Kowalik

[57] ABSTRACT

A closure for a container having a small diameter neck at the upper end of a generally frusto-conical upper end portion of the body of the container, the neck being formed as a curl and providing a pour opening which is closed by a thin sheet metal plug having a cylindrical wall closed at its lower end by a radial wall, both walls being expanded to underlap the lower edge of the neck, the upper end of said cylindrical wall being curled outwardly against a sealing agent on the upper end of the neck curl. The radial wall, the cylindrical wall and the curl portion are scored to form a tear strip which is connected to a tab which overhangs the body portion of the container and is operative upon being upwardly pulled to tear the tear strip and thus rip open the closure for easy removal.

10 Claims, 14 Drawing Figures

CLOSURE HAVING OPENING MEANS

BACKGROUND OF THE INVENTION

Various types of closures have been used for narrow necked containers. Typical closures are commonly known as crown closures which have a top wall overlying the top edge of the neck and a cork or plastisol seal is interposed between the top wall and top edge of the neck. The top wall is connected to a peripheral skirt which is crimped about the neck finish. This type of closure is used primarily on bottles or cans which have strong axial strength.

DESCRIPTION OF THE PROBLEM

The type of container to which the present invention is applied has a thin 4–7 mil thick wall. It is therefore weak in axial and radial section. This lack of strength inhibits application of impact applied closures. The walls being too thin and easily collapsible prevent application of conventional closures.

SOLUTION OF THE PROBLEM

The invention appertains to a closure made of thin sheet metal which is applied to a specially formed neck essentially made in the form of a torous or outturned curl which on its lower side is buttressed against the top of the frusto-conical portion of the top part of the container. This maximizes the strength of the construction. The closure cap is placed within the pour opening defined by the curl and reshaped on its side and transverse wall to conform to the shape of the curl thus locking the cap in place and reinforcing the neck portion. The bottom transverse wall, the side wall and a top transverse curl of the closure cap are scored with continuous score lines defining a tear strip therebetween which continues as a tab to the side of the container. The tab is liftable to tear the strip out thus allowing the closure to collapse radially so that it may be easily pulled out.

These and other objects and advantages inherent in and encompassed by the invention will become more apparent from the specification and the drawings, wherein.

Figure 11:
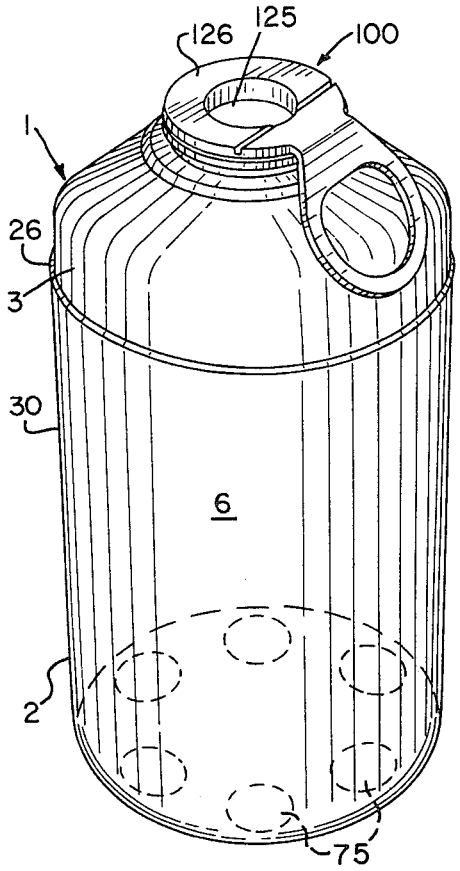
FIGS. 11–14 illustrate a further embodiment of the invention.
Figure 12:
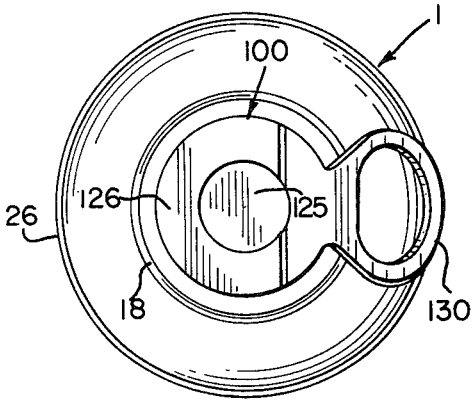
Figure 13:
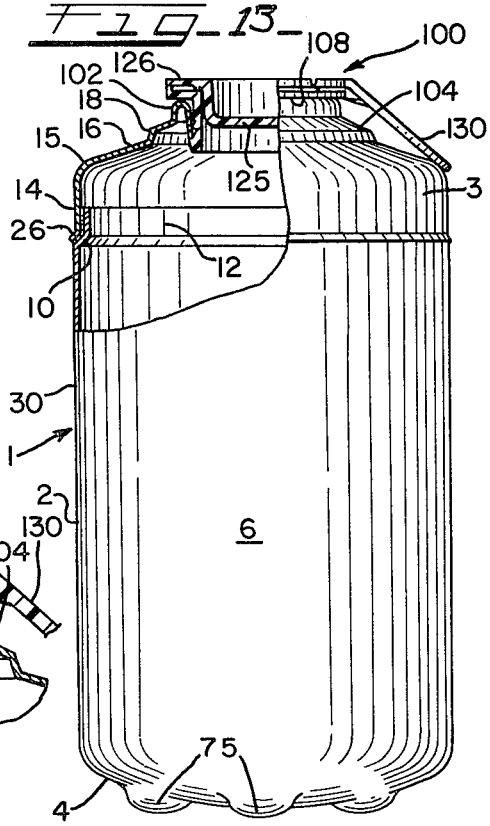
Figure 14:
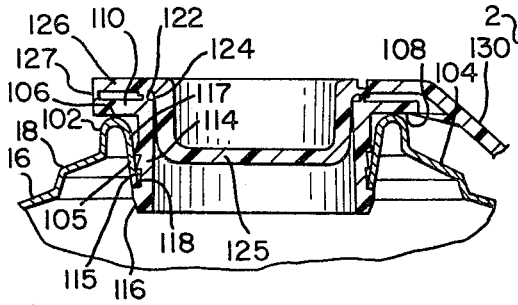

FIG. 11 being a perspective view;

FIG. 12 being a top plan view,

FIG. 13 being a side elevational view partly in vertical section taken substantially on line 13—13 of FIG. 12; and FIG. 14 is an enlarged portion of a part of FIG. 13.

DESCRIPTION OF FIGS. 1–5 OF THE INVENTION

The invention as shown in FIGS. 1–5 of the drawings, comprises a novel container, generally designated 1, preferably entirely formed of one alloy of aluminum such as H19-3004.

The container has a lower or bottom portion 2 and an upper or top portion 3. The lower portion comprises a bottom 4 and an integral cylindrical body 6 which at its upper end 8 is necked in to provide a radially inwardly extending shoulder 10 about 1/32 to 1/16 of an inch wide and about the inner edge of which there is an axially extending annulus or ring 12 of approximately $\frac{1}{8}$ of an inch in length.

Figure 2:
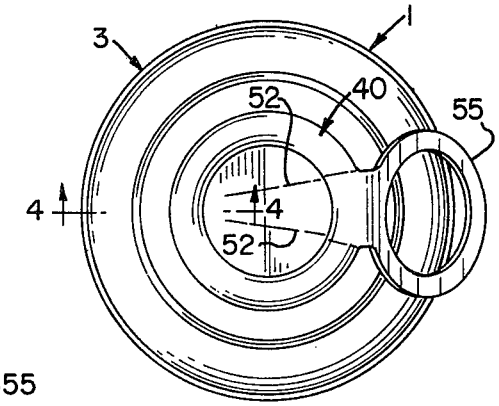
FIG. 2 is a top plan view thereof.
Figure 1:
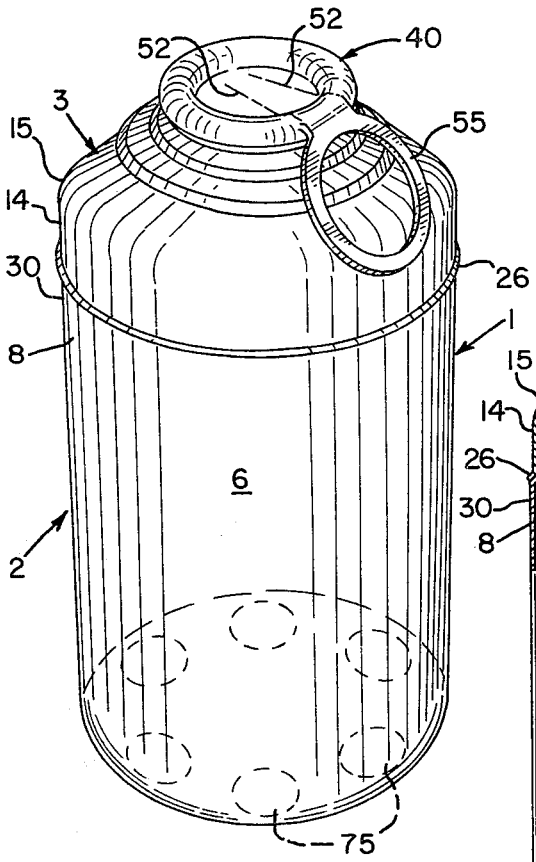
FIG. 1 is a perspective view of one embodiment of the invention.
Figure 3:
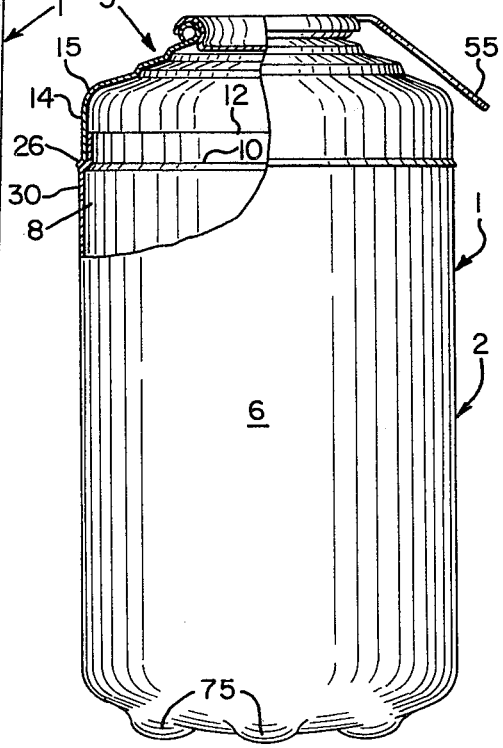
FIG. 3 is a side elevational view thereof shown partly in axial section.
Figure 4:
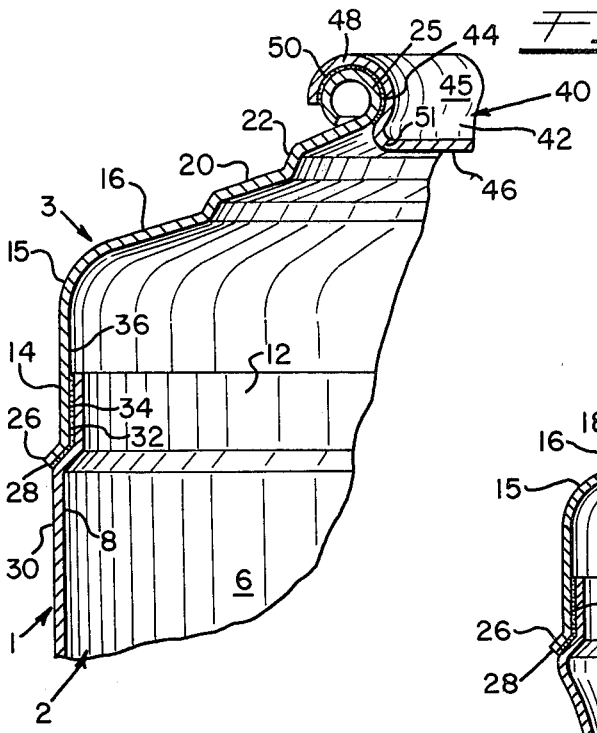
FIG. 4 is an enlarged fragmentary sectional view taken substantially on line 4—4 of FIG. 3.
Figure 5:
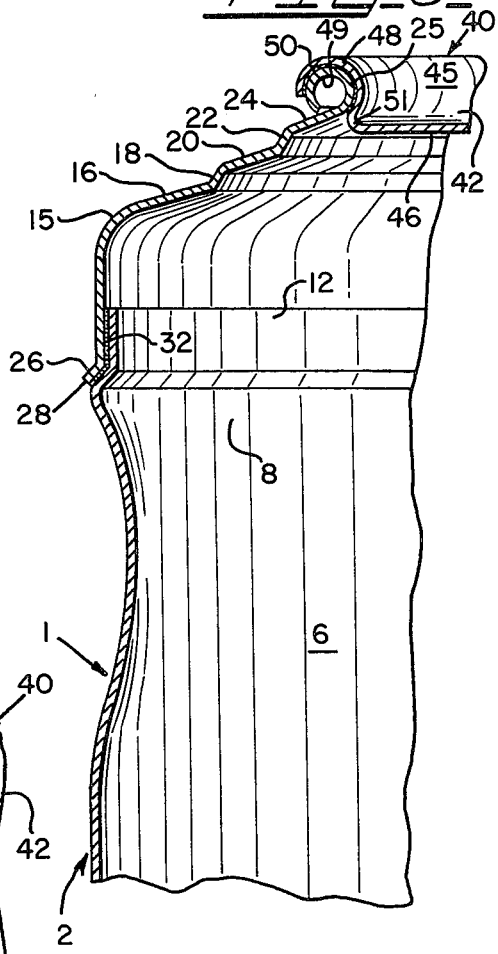
FIG. 5 is a view similar to FIG. 4 showing the container wall portion partly inducted.

The annulus or ring 12 has a tight or interference fit into the lower end of an annular band or lip 14 of the top portion 3 which is about 0.837 inches in total axial depth. The upper edge of the lip 14 merges into the lower edge of a toroidal section 15 which at its upper edge merges into the lower edge of a conical section 16. The conical section 16 shown in FIGS. 1 and 5 is of a stepped design and comprises a frusto-conical annular ban 18 which merges at its lower edge with the upper edge of the toroidal section and the upper edge of band 18 merges with the lower edge of the conical segment 20 which at its upper edge in turn merges into the lower edge of a second smaller frusto-conical band 22, the latter having its upper edge merging into the lower edge of a second frusto-conical section 24 which at its upper edge merges into a curl 25 which is turned outwardly over the second section 24.

The lower edge of the lip 14 is provided with an outturned downwardly flaring frusto-conical flange 26 which has an outer edge substantially coaxial with the external circular surface 30 of the body portion of the container. A preferably thermoplastic resin or adhesive such as polyvinyl chloride and thermoplastic resin such as polyethylene or polypropylene or alternatively thermosetting epoxy or vinyl plastisol resin, is applied to the outer side 34 of the ring 52 and to the inner surface 36 of the lip prior to assembly of the top to the lower portion so that after assembly the assembled can is heated to a temperature melting the plastic adhesive during which time the top and lower portions of the can are relatively axially or circumferentially moved to eliminate any pin holes or the like formed in the adhesive and to promote good adhesion of the adhesive to the metal parts. Upon cooling, the adhesive bonds the parts together.

In the instant invention, a metal closure 40 is shown in FIGS. 1–10 for purposes of illustration, it being understood that plastic closures of various kinds such as shown in FIGS. 11–13 may also be used. The closure comprises a center plug 42 which fits into the pour opening 44. The plug has an axially extending side wall 45 which at its lower end is connected to a bottom wall 46 and at its upper end has a downwardly open outward curl 48 which overlays the convex upper side 49 of the curl 25 and is drawn tightly against a foam gasket sealing material 50 applied thereto by mechanically crimping and expanding the side wall 45 of the plug to form a shoulder 51 under the curl.

The wall 46, side wall 45 and curl 48, are scored at 52,52 and a ring type opener 55 is formed with the closure or cap and bent downwardly to extend generally parallel with the conical section of the upper portion. The closure is readily opened by lifting the ring 55 thus breaking the scores 52,52 and thus lifting the closure out of the pour opening.

One of the features of the invention is that the side wall of the body portion of the can is made of substantially uniform thickness on the order of 4 mils although cans have been made from material of between 12 and 8 mils and with reduction in side wall thickness to 5 and 4 mils respectively. The side wall thickness has been maintained substantially uniform from end to end, there being no necessity for a thick zone about the open end since the double seaming has been eliminated. It is, however, feasible to make the entire side wall of the container of a metal thickness of about 4 mils and the bottom of about 4–8 mils. However, if desired, variable thicknesses may be incorporated in various zones of the side wall.

The novel telescoping arrangement of the lip of the top and the necked-in band of the bottom portion and the provision of the outturned flange on the lower edge of the lip has been found to provide exceptional resistance to impact breeching of the connection. The flange 26 materially improves the radial strength of the lip portion of the top and the configuration of the lip and torroidal and conical sections develop a compression loading on the connection which together with the radial shoulder and necked in band of the lower section resist inward displacement and thus do not extend peel stresses to the adhesive.

This feature is amply illustrated in FIG. 5 wherein the body portion is depressed immediately below the necked in region. The shoulder 10 stops the body from deflecting inwardly and thus prevents peeling of the adhesive. Furthermore, the thin metal top, upon being pressurized, when the can is filled with pressurized beverage, becomes a prehensible member and wants to expand its conical section into a sphere. This in turn loads the lip portion in compression which resists the expansion of the necked-in portion and holds the adhesive in compression therebetween.

EMBODIMENT OF FIG. 6

In this embodiment, as well as all others, parts which are identical with the other embodiments are identified by the same reference numerals.

Figure 6:
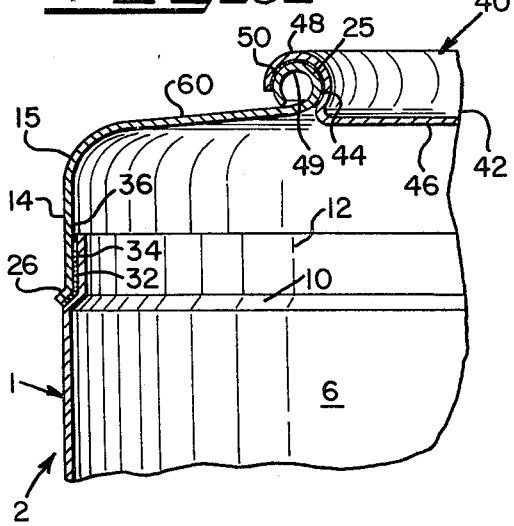
FIG. 6 illustrates a further embodiment incorporating a modified upper portion of the container.
Figure 7:
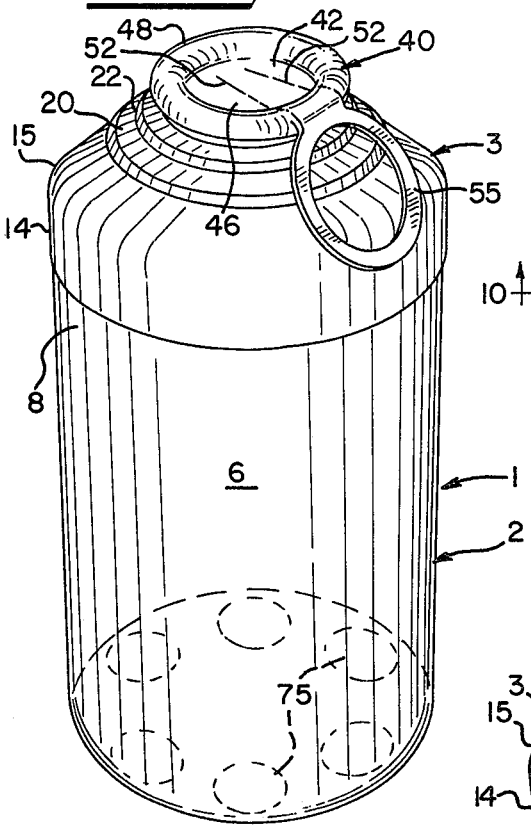
FIG. 7 is a perspective view illustrating a further embodiment of the invention.
Figure 8:
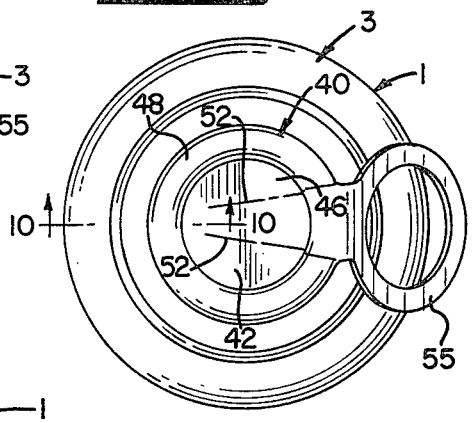
FIG. 8 is a top plan view thereof.
Figure 9:
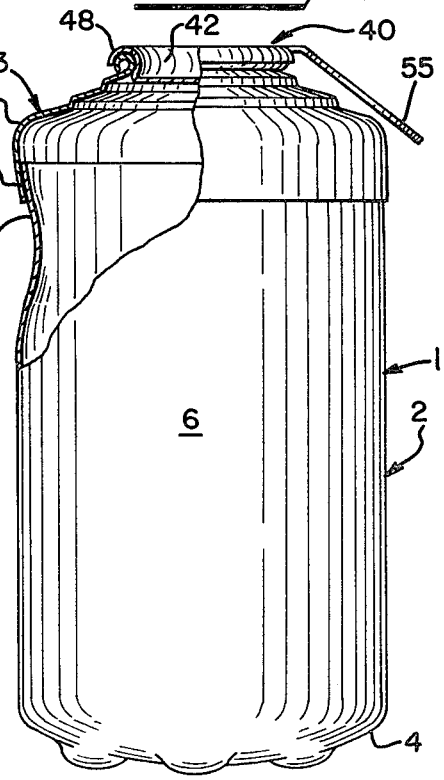
FIG. 9 is a side elevational view thereof partly in axial section.
Figure 10:
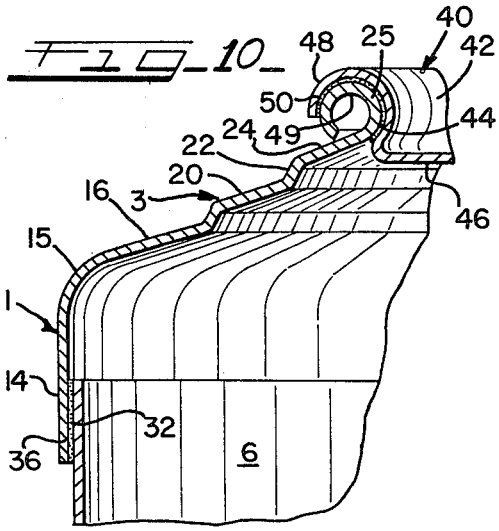
FIG. 10 is an enlarged cross-section taken substantially on line 10—10 of FIG. 8.

As seen in FIG. 6, the top portion of the container is an unstepped conical section. In this embodiment the transition from the toroidal section 15 to the curl is a smooth single conical section 60 a design satisfactory depending on the stacking strength required of the container.

EMBODIMENT OF FIGS. 7–10

In this embodiment the necked-in structure at the upper end of the body section is eliminated and the upper end of the body portion 6 is a continuous cylinder which is slightly precompressed and fitted into the lip 14 of the top portion 3. The adhesive is thus held in compression between the lip 14 and the upper portion of the body 6.

In this embodiment the bottom and top portions of the container are of the same diametrical dimension. The bottom portion is precompressed about its upper edge portion 8 prior to insertion into the top lip 14 of the upper portion and then is released compressing the adhesive between the inner surface of the lip and the outer surface of the upper portion 14. The adhesive is preferably a thermoplastic type such that after the container portion of any of the previous or subsequent embodiments are assembled and they are passed through a heating chamber, the adhesive melts and fuses the top and bottom portions into a unitary structure. In this embodiment it will be appreciated that the joint is flexible because of the wall thicknesses being of the order of 4–8 mils, preferably the former and the adhesive is flexible. Thus, when the container is struck with a side blow in the body wall adjacent to the joint, the extremely thin section of material, that is, the metal and the plastic adhesive, allows the joint to flex inwardly thus attenuating the forces and inhibiting these forces from applying peeling loads on the adhesive and separating the inner portion from the lip.

EMBODIMENT OF FIGS. 11–14

In this embodiment the structure of the bottom portion 2 is the same as in the embodiments of FIGS. 1–5.

The top, however, is made to accommodate a different type of closure 100.

In this embodiment the neck 102 at the top of the stepped cone 104 is elongated and has an inturned frusto-conical lip 105 which forms a smooth apical annulus 106 against which the bottom side 108 of a radial flange 110 of the plastic closure 100 seats.

The flange 110 is connected to a hollow sleeve 114 which fits into the lip 105 and has external sealing shoulders or rings 115 and 116. Shoulder 115 wedges against the top internal angular surface 117 of the lip 105 and the shoulder 116, which is at the bottom of the sleeve 114 underlaps the lower edge 118 of the lip 105 and tightly engages therewith. At the juncture of the upper end of the sleeve 114 and flange 110 there is provided an integral tearable thin membrane 122 which is also integral with the outer peripheral edge portion 124 of a depressed closure plug 125 which is integrated with a hinge ring 126 connected by hinge 127 to the flange 110 and at the diametrically opposite side to a pull tab 130 which is angled downwardly toward the cone top portion. Lifting of the tab rips the membrane 122 and opens the container.

It will be noted that in each container, the bottom 4 is convex and has feet 75. The bottom wall thickness is usually the initial thickness of the blank sheet preparatory to forming of the can, that is 10–6 mils, preferably 8 mils, thick. The body wall is ironed to about 5 mils or less. The top portion is also less than 10 mils thick preferably 4–7 mils and the pour opening is less than 30% of the bottom area. The angle of the conical portions is between 25–30 degrees in the stepped designs, as well as in the unstepped design of FIG. 6. However, to obtain greater axial strength, an angle of 45 degrees would be preferred, but that is dependent upon other desired parameters. The stepped design greatly improves the axial strength of the top.

It will become apparent from the foregoing disclosure that novel lightweight pressure holding containers have been developed which adequately contain pressurized beverages, use a minimum amount of metal and strategically employ the metal to obtain a container of improved characteristics which constrain the forces to act in favorable manner assisting in holding the adhesive bond from being breeched.

I claim:

1. A closure for a container wherein the container is of the type having a neck joined to an upper end of a frusto-conical body portion and forming a pour aperture, said neck being defined by a smoothly curved outturned extension of said body portion in the form of a rounded curl, said closure comprising a plug fitted within said neck and having a side wall complementally seated against the interior of the neck and having a bottom wall closing said aperture, said side wall and bottom wall having portions expanded radially beneath said neck and said side wall portion and complementally underlapping the upper end of the frusto-conical portion and complementally underlapping the upper end of the frusto-conical portion, and means for rupturing said closure to facilitate removal thereof.

2. The invention according to claim 1 and said means comprising a tab integral with said plug, and rupturable score line means in said plug walls defining a continuation of the tab for removing said plug.

3. The invention according to claim 2 and said side wall of the plug having a curl overlapping the curl of said neck.

4. The invention according to claim 2 and said tab extending laterally from said plug and angled toward said body portion.

5. The invention according to claim 4 and said tab having a handle portion in the form of a finger ring.

6. In a container having a domed top comprising a cylindrical neck having an upper end defining a pour opening and an outwardly flared body portion joined to the lower end of the neck, a closure comprising a thin sheet metal plug complementally fitted within said opening and having portions tightly embracing the upper and lower ends of said neck, and means for rupturing said sheet metal and thereby removing the plug.

7. The invention according to claim 6 and said means for rupturing the sheet metal comprising a tab made of the same sheet as the plug and extending laterally therefrom, and said plug having a pair of laterally spaced scores extending from the inner end of the tab, and said plug having the metal thereof between the scores extending as an uninterrupted continuation of said tab, said plug having a curl overlapping the upper end of the neck and said curl having said scores formed therein.

8. A container for pressurized fluids and closure therefor, said container being made of thin sheet metal on the order of 4–8 mils in thickness and comprising a body having an integral bottom and a top, said top comprising a frusto-conical portion terminating in a neck made essentially as an outturned curl and defining a pour opening, and a plug fitted within said neck and having a side wall wrapped about said neck in closing relation to said opening and in reinforcing relation to said neck, and means on said plug for removing said plug from said opening.

9. A closure for a container wherein the container is of the type having a neck joined to an upper end of a frusto-conical body portion and forming a pour aperture, said closure comprising a plug fitted within said neck and having a side wall complementally seated against the interior of the neck and having a bottom wall closing said aperture, said side wall and bottom wall having portions expanded radially beneath said neck and said side wall portion and complementally underlapping the upper end of the frusto-conical portion, and means for rupturing said closure to facilitate removal thereof, said means comprising a tab integral with said plug, and rupturable score line means in said plug walls defining a continuation of the tab for removing said plug, said tab extending laterally from said plug and angled toward said body portion.

10. The invention according to claim 9 and said tab having a handle portion in the form of a finger ring.

* * * * *